US007091829B2

(12) United States Patent
Lee

(10) Patent No.: US 7,091,829 B2
(45) Date of Patent: Aug. 15, 2006

(54) SYSTEM AND METHOD FOR INFORMING A CRITICAL SITUATION BY USING NETWORK

(75) Inventor: Hong-Kyu Lee, Bupyeong-gu (KR)

(73) Assignee: Hong-Kyu Lee, Incheon (KR)

( * ) Notice: Subject to any disclaimer, the term of this patent is extended or adjusted under 35 U.S.C. 154(b) by 269 days.

(21) Appl. No.: 10/826,815

(22) Filed: Apr. 16, 2004

(65) Prior Publication Data

US 2004/0201473 A1 Oct. 14, 2004

Related U.S. Application Data

(63) Continuation of application No. PCT/KR02/01938, filed on Oct. 17, 2002.

(30) Foreign Application Priority Data

Oct. 17, 2002 (KR) ..... 10-2001-0063876

(51) Int. Cl.
*G08B 5/36* (2006.01)

(52) U.S. Cl. ..... 340/286.12; 340/506; 340/3.1; 340/539.25; 340/286.02

(58) Field of Classification Search ..... 340/286.12, 340/937, 506, 539.1, 539.25, 3.1, 286.02
See application file for complete search history.

(56) References Cited

U.S. PATENT DOCUMENTS

| | | | | |
|---|---|---|---|---|
| 5,400,246 | A * | 3/1995 | Wilson et al. | 700/17 |
| 5,884,042 | A * | 3/1999 | Winter et al. | 709/231 |
| 6,292,098 | B1 * | 9/2001 | Ebata et al. | 340/506 |

FOREIGN PATENT DOCUMENTS

| | | |
|---|---|---|
| EP | 1 061 758 A1 | 12/2000 |
| EP | 1 133 104 A2 | 12/2001 |
| JP | 11-69454 | 3/1999 |
| JP | 2001-238247 | 8/2001 |
| KR | 10-1996-0004154 | 3/1999 |

* cited by examiner

*Primary Examiner*—Daryl C. Pope
(74) *Attorney, Agent, or Firm*—Knobbe Martens Olson & Bear LLP

(57) ABSTRACT

The present invention relates to system and method for informing a critical situation by using network, to ask for help about present danger to Crime Prevention Center. When a user is facing a dangerous person, the user inputs images or a voice of the dangerous person to ask for help using an image input apparatus in a stealthy way. Then, the image input apparatus automatically transmits the inputted image data and/or voice data as well as present position data of the user to a security system. Thereby, the user can inform the security system of his danger even if the user is having difficulty in inputting an alarm button or is on his movement, and can operate the image input apparatus at will without limitation of position.

27 Claims, 15 Drawing Sheets

FIG. 10B

| HEADER | TER_INF | CON_INF | IMA_DAT | SND_DAT | LOC_DAT | TAIL |
|---|---|---|---|---|---|---|

SYSTEM AND METHOD FOR INFORMING A CRITICAL SITUATION BY USING NETWORK

RELATED APPLICATIONS

This application is a continuation application, and claims the benefit under 35 U.S.C. §§ 120 and 365 of PCT Application No. PCT/KR02/01938, filed on Oct. 17, 2002 and published on May 15, 2003, in English, which is hereby incorporated by reference.

BACKGROUND OF THE INVENTION

1. Field of the Invention

The present invention relates to a method and system for informing a critical situation by using a network, to ask for immediate help about present danger to Crime Prevention Center.

2. Description of the Related Technology

Presently security systems are widely being used in general houses, apartment blocks, enterprises, etc. The prior security system watches for the existence of an external intruder. Hereinafter, the general classification of the prior security system will be described.

Regarding the first type of the prior security system, if the security system perceives the existence of an intruder in a watch domain where an infrared sensor is set up, then a warning notice is displayed and an alarm signal is transmitted at a long distance. For the second type of the prior security system, if a guard confirms the existence of an intruder in a watch domain, he pushes an alarm button in order to notify a critical situation to an external Crime Prevention Center. The first type is applied when people are not present in the watch domain, and the second type is applied when a people are present in the watch domain.

The prior security system has a problem because the system does not provide help when a user confronts a dangerous intruder or cannot push the alarm button. Also, because the prior security system is restricted to a fixed domain, the user cannot use the security system in a mobile way.

SUMMARY OF CERTAIN INVENTIVE ASPECTS OF THE INVENTION

One aspect of the invention is to provide a method and system for informing a critical situation by using a network to ask for immediate help about present danger to Crime Prevention Center when a user confronts a dangerous person or cannot push the alarm button.

Another aspect of the invention is to provide a method and system for informing a critical situation by using a network to ask for immediate help about present danger to Crime Prevention Center when a user faces a critical mobile situation.

Another aspect of the invention is to provide a method and system for informing a critical situation by using a network to judge the critical situation correctly by controlling the image input angle of an image input apparatus externally and freely.

Another aspect of the invention provides a method for inputting image data informative of the security situation (e.g., and intruder and a surrounding situation) in response to a user's image input request, converting the image data according to a predetermined image conversion method (e.g., to a form communicable over the communications network), and transmitting the image data to a portable terminal on a wired network or a wireless local area network, wherein the portable terminal transmits the image data over a mobile wireless communication system to a security system, and the portable terminal comprises at least any one of a mobile wireless communication terminal, a personal computer and a PDA (personal digital assistant).

The method further comprises determining whether or not an image-angle-change command to change the angle of an image input unit has been inputted by the user or received from the security system, changing the angle of the image input unit if the image-angle-change command has been inputted or received, and inputting an image data corresponding to the changed angle of the image input unit, wherein the image-angle-change command inputted by the user is inputted by a user interaction with the portable terminal. If a voice data input request is inputted by a user or received from the security system, then method further comprises the steps of inputting sound data (e.g., voice data) informative of the security situation (e.g., the intruder's voice and surrounding sound), converting the voice data according to a predetermined voice conversion method (e.g., to a form communicable over the communications network) and transmitting the sound data to the security system.

The method further comprises determining whether or not an alert signal data has been received from the security system through the mobile wireless communication system, and outputting the alert signal data on a user's sound device when the alert signal data is received.

The method further comprises receiving geographic information from a GPS satellite, determining a current location by using the geographic information, converting the current location into location data communicable over the communications network, and transmitting the location data to the security system.

The method further comprises transmitting a data comprising a right-given command from the user to the security system to allow a remote control of the angle of the image input unit.

Another aspect of the invention provides a method for relaying data informative of a security situation faced by a user over a mobile communication network in a mobile communication system, the method is provided for receiving an image data informative of a security situation from at least any one of a portable terminal and an image input apparatus coupled to a vehicle through a mobile communication network, searching information corresponding to the user whereby the user information comprises at least any one of the user's telephone number and IP address, obtaining the user's location, converting the location into location data communicable over the communications network, and transmitting the image data and the location data to a security system.

The method further comprises receiving a sound data informative of the security situation (e.g., an intruder's voice) from any one of the portable terminal and the image input apparatus, and transmitting the sound data to the security system.

Another aspect of the invention provides a method for providing assistance to a user facing a security situation, the method is provided for receiving an image data from any one of a portable terminal and an image input apparatus through a communication network, wherein the image data is informative of the security situation (e.g., an intruder), storing the image data in a storage medium, displaying the image data on a screen, and utilizing the data to inform security staff about the security situation, wherein the image data is stored automatically or in response to a security staff's image storage command.

The method further comprises inputting an angle-change command to change the angle of the image input apparatus from the security staff, and transmitting the angle-change command to any of the portable terminal and the image input apparatus.

Here, the transmitting the angle-change command may comprise determining whether or not the security system received a right-given command from any of the portable terminal and the image input apparatus to allow a remote control of the angle of the image input unit.

The method further comprises receiving location data from any of the portable terminal and the image input apparatus, and displaying the user's location on the screen by using the location data, wherein the location data is displayed as a map or text.

The method further comprises receiving sound data informative of the security situation (e.g., the intruder's voice) from any of the portable terminal and the image input apparatus, and storing the sound data in the storage medium.

The method further comprises inputting an alert signal by the security staff responsive to the security situation, converting the alert signal into alert signal data communicable over the communications network, and transmitting the alert signal data to any of the portable terminal and the image input apparatus over the communication network

BRIEF DESCRIPTION OF THE DRAWINGS

The above objects and other advantages of embodiments of the present invention will become more apparent by detailed descriptions of the preferred embodiments thereof with reference to the attached drawings, in which:

FIG. 10B is a data model used for informing a critical situation according to another embodiment of the invention.

DETAILED DESCRIPTION OF CERTAIN EMBODIMENTS OF THE INVENTION

Hereinafter, preferred embodiments of the present invention will be described in more detail with reference to the accompanying drawings, but it is understood that the present invention should not be limited to the following embodiments.

In one embodiment, the user can be an automobile driver currently driving, a woman returning home in the late night, a driver parking a vehicle in an underground parking garage, etc. Hereinafter, we will describe the present invention for the situation of the driver driving his vehicle.

Figure 1:
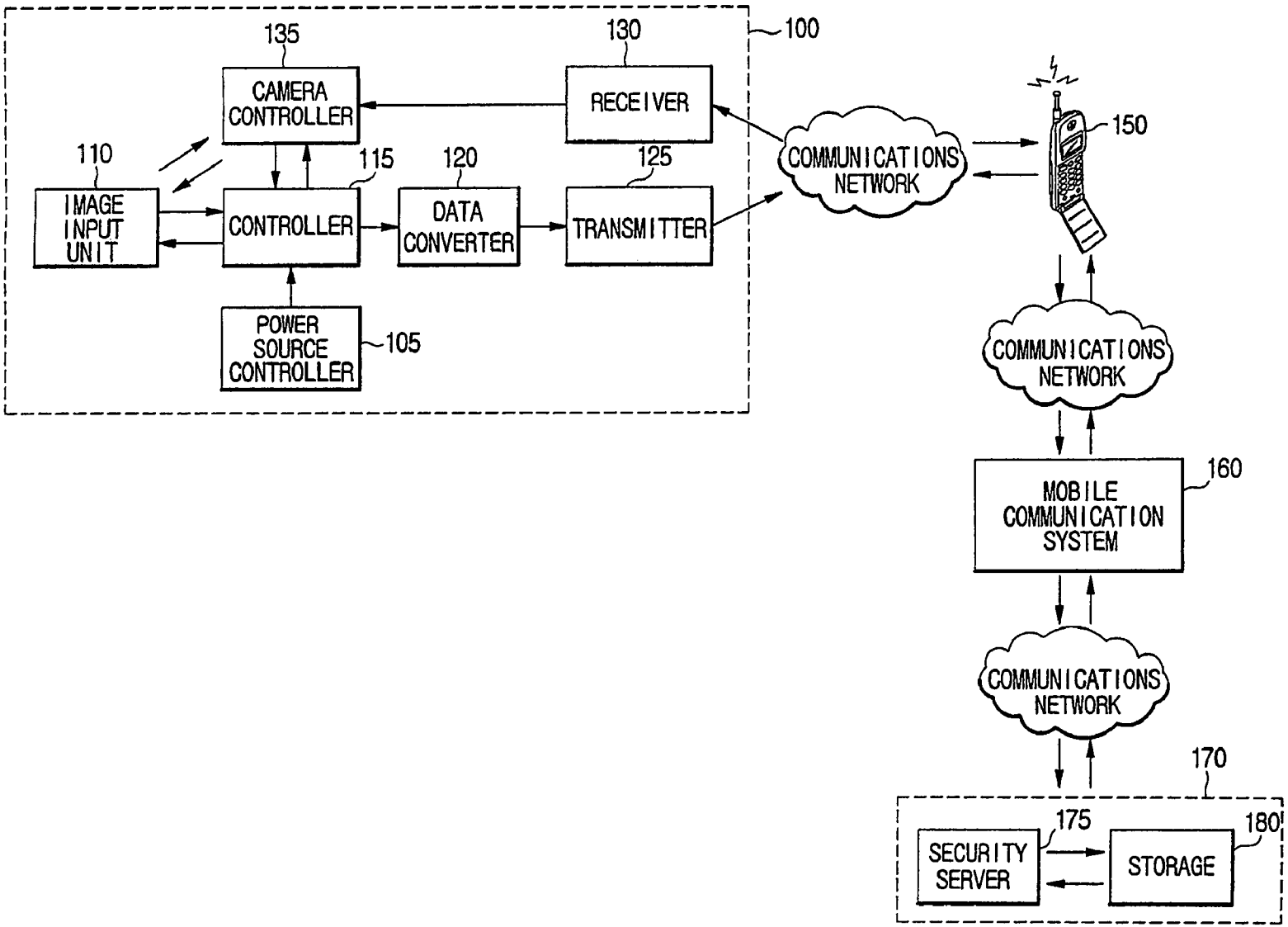
FIG. 1 is a schematic diagram of the system for informing a critical situation by using a network according to one embodiment of the invention.
Figure 2A:
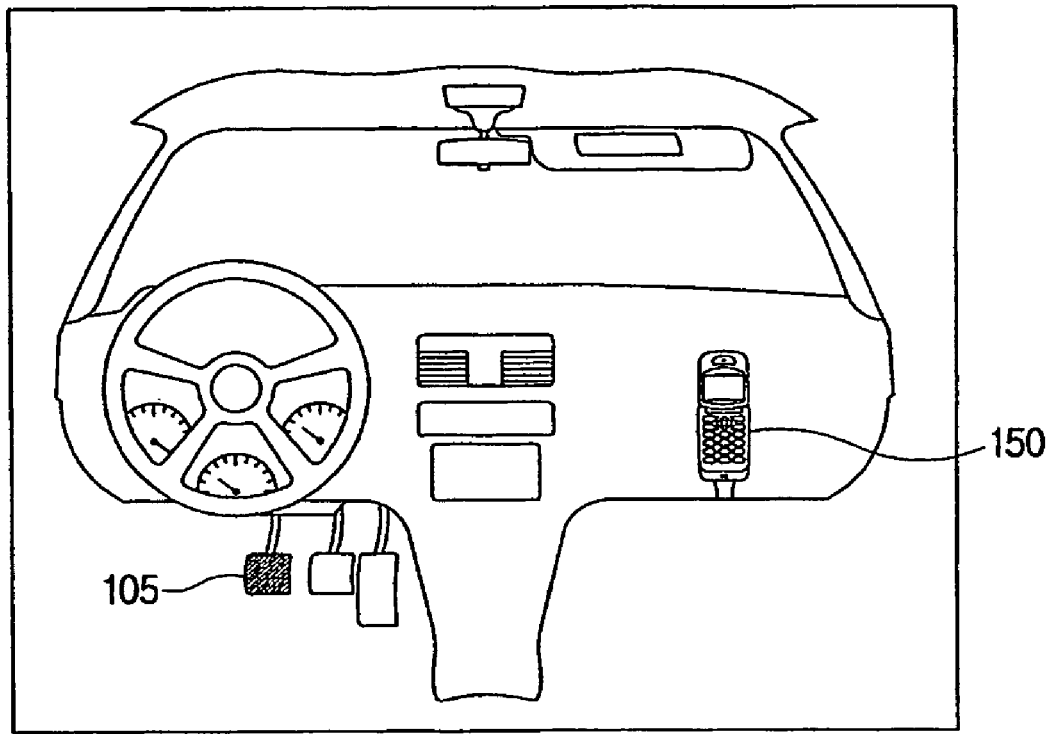
FIG. 2A to FIG. 2C are examples of the system for informing a critical situation according to one embodiment of the invention.
Figure 2B:
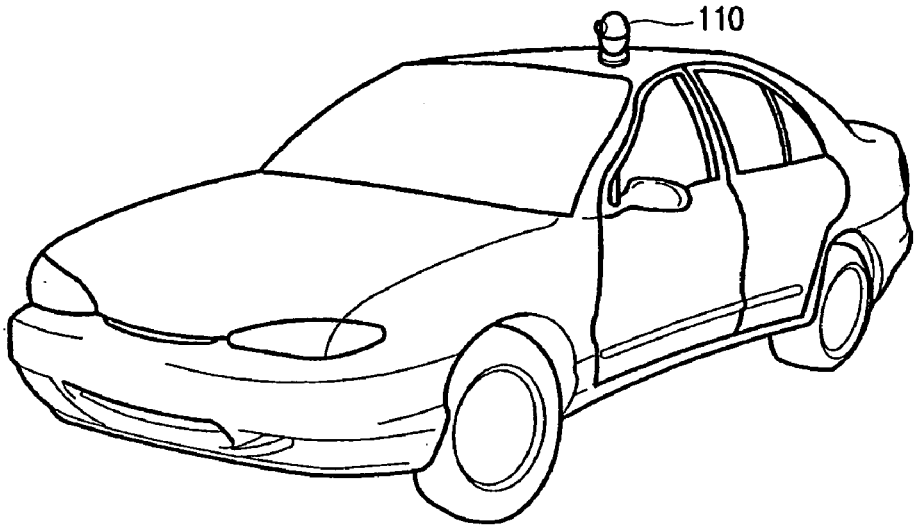
Figure 2C:
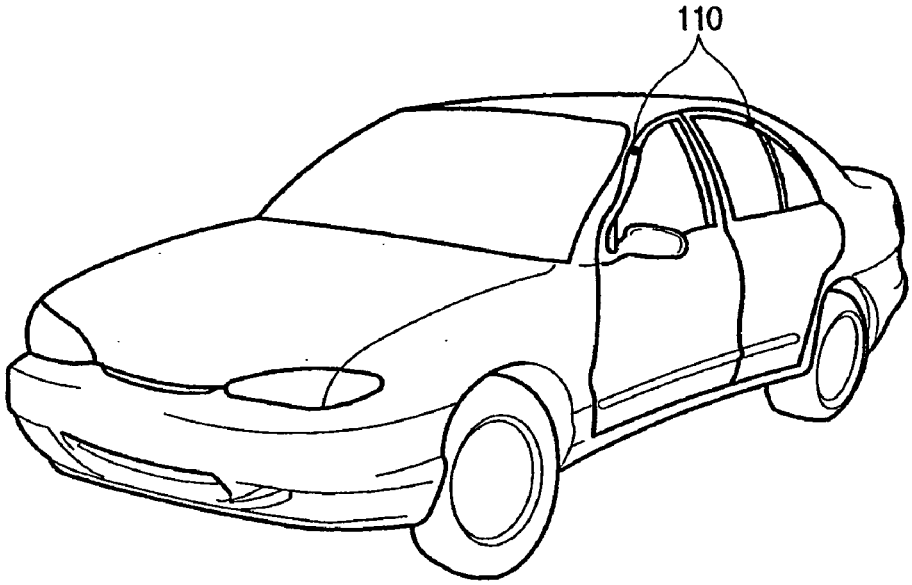

FIG. 1 is a schematic diagram of the system for informing a critical situation by using a network according to one embodiment of the invention and FIG. 2A to FIG. 2C are examples of the system for informing a critical situation according to one embodiment of the invention.

Referring to FIG. 1, the critical situation informing system can comprise an image input apparatus 100, a portable terminal 150, a mobile communication system 160, a security system 170, etc.

The image input apparatus 100 can comprise a power source controller 105, an image input unit 110, a controller 115, a data converter 120, a transmitter 125, a receiver 130, a camera controller 135, etc.

The power source controller 105 is a means for inputting a command operation start and a command operation end for the image input apparatus 100.

The image input unit 110 is a means for inputting an image around the vehicle by the control of the controller 115 after the command operation start is inputted by the power source controller 105.

The data converter 120 converts the image data, which is inputted by the image input unit 110, into the digital image data by using an analogue digital converter and compresses the digital image data to JPEG type or MPEG type digitally.

The transmitter 125 transmits the image data, which is converted by the data converter 120, to the portable terminal 150. The receiver 130 receives some control data, which is transmitted from the portable terminal 150, of the image input apparatus 100. The control data can be a movement of the camera direction, zoom function, etc.

The controller 115 of the camera controller 135 controls an action of the image input unit 110 corresponding to the received control data. The action can be a change of the camera direction, an enlargement of the image, a reduction of the image, etc.

Also, in one embodiment, the system of the present invention can transmit and receive voice data if the system comprises a voice input-output apparatus.

The portable terminal 150 can be any apparatus comprising a communication function and connecting the security system 170. For example, the portable terminal can be one selected from the group consisting of a mobile communication terminal and a PDA(personal digital assistant). We will describe the present invention in the case of a mobile communication terminal.

The image input apparatus 100 can transmit data to the portable terminal 150 and receive data from the portable terminal 150 by using the local area wireless network. Also, the image input apparatus 100 can transmit data to the portable terminal 150 and receive data from the portable terminal 150 by being coupled through a wired network.

Referring to FIG. 2A, the location of the power source controller 105 and the portable terminal 150, which can be set up in the vehicle, is described.

The power source controller 105 is a means for inputting the command operation start and the command operation end of the image input apparatus 100. The power source controller 105 can be set up next to a clutch pedal of the user's vehicle to secretly input the command operation start without knowledge to the intruder of the same.

Also, the function of the power source controller 105 can be added to a steering wheel. Furthermore, when the vehicle is started, touched by someone else, or involved in a collision with another vehicle, then the power can be started automatically.

Also, the portable terminal 150 can be coupled with a hands-free apparatus or located in the driver's pocket while the driver is in the vehicle.

Because the image input apparatus 100 and the portable terminal 150 are located within one meter of each other in the vehicle, the image input apparatus 100 can transmit data to the portable terminal 150 and receive data from the portable terminal 150 by using the local area wireless network. Also, the image input apparatus 100 can transmit data to the portable terminal 150 and receive data from the portable terminal 150 by being coupled through a wired network.

FIG. 2B and FIG. 2C are examples of the image input unit 110 according to one embodiment of the invention.

The image input unit 110 is set in some area of the hood, the ceiling, or the trunk of the vehicle in an opening and closing method. When the area is open, the image input unit 110 appears to the outside. And then, the image data indicative of the surrounding situation are inputted by the image input unit 110.

The image input unit 110 can move freely up and down or right and left and input images of every direction.

Referring to the FIG. 2C, the image input unit 110 can be set up on the window of the vehicle. If the watch angle of the image input unit 110 is set up as 360°, then the image input unit 110 can input images of every direction.

Because the image input unit 110 of FIG. 2B is exposed, the intruder can perceive the security system and breakdown the image input unit 110.

On the other hand, the image input unit 110 of FIG. 2C can assist this weak point.

More than one image input unit 110 can be set up, and the image input unit 110 can be attached on the vehicle or removed from the vehicle. Also, the image input unit 110 can be moved.

Also, the security system 170 can be set up at a police station, a security company, etc. in order to provide help in response to the user's emergency signal. The security system 170 can comprise a security server 175, storage, etc.

FIG. 3A to FIG. 3E are flowcharts illustrating the process of informing the driver's critical situation according to one embodiment of the invention and FIG. 4A to FIG. 4D are examples of screens displaying situational information according to one embodiment of the invention.

Figure 3A:
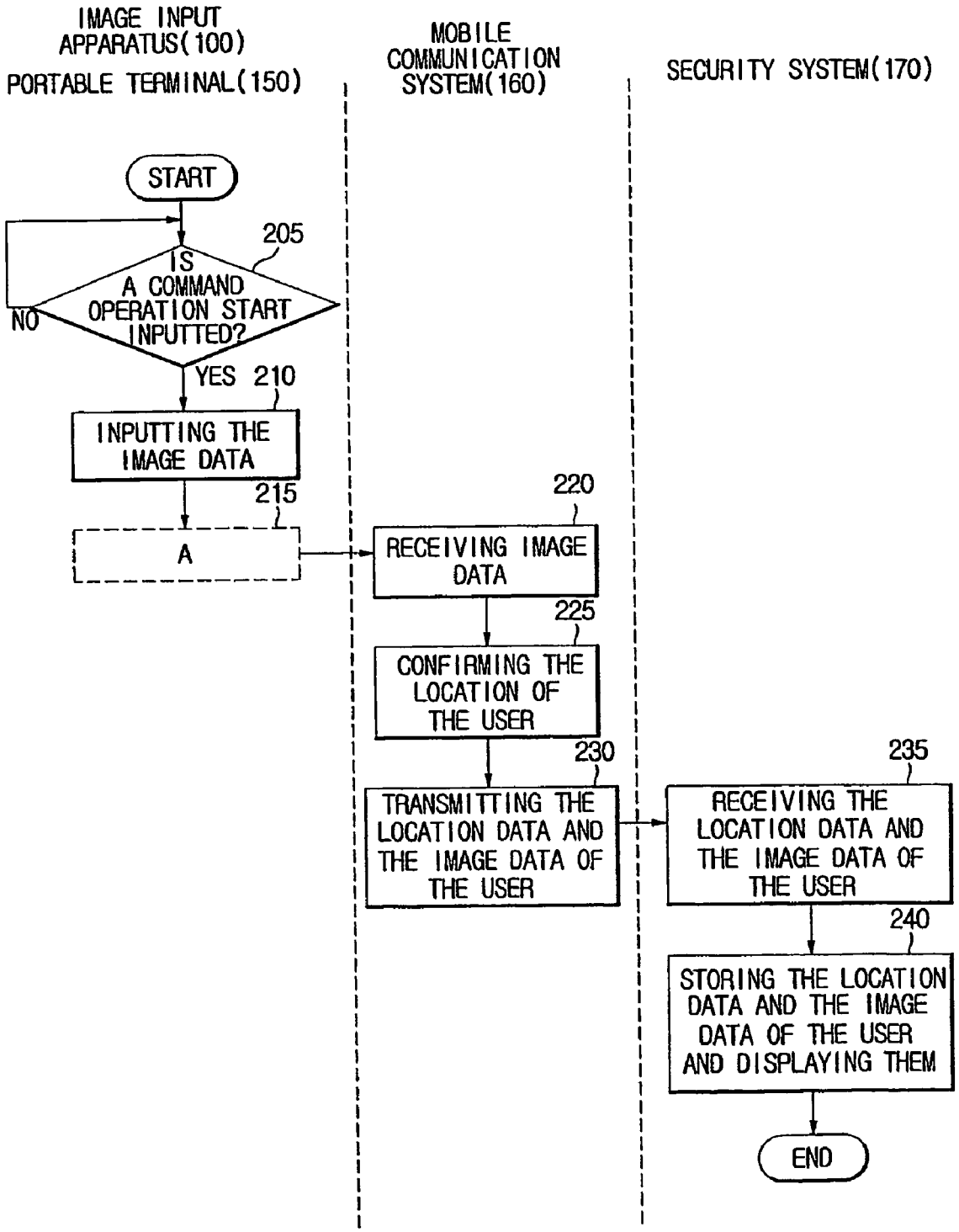
FIG. 3A to FIG. 3E are flowcharts illustrating the process of informing the driver's critical situation according to one embodiment of the invention.

FIG. 3A is a flowchart illustrating the general process of informing the driver's critical situation, and FIG. 3B to FIG. 3E are various types of the step 215 of FIG. 3A.

Referring to FIG. 3A, the power source controller 105 of the image input apparatus 100 determines whether or not the command operation start (i.e., operation-start command) is inputted by the driver (step 205).

If the command operation start is inputted, then the controller 115 of the image input apparatus 100 inputs image data of the surrounding situation (step 210). On the other hand, if the command operation start is not inputted, then the image input apparatus 100 waits until the user inputs the command operation start.

Figure 3B:
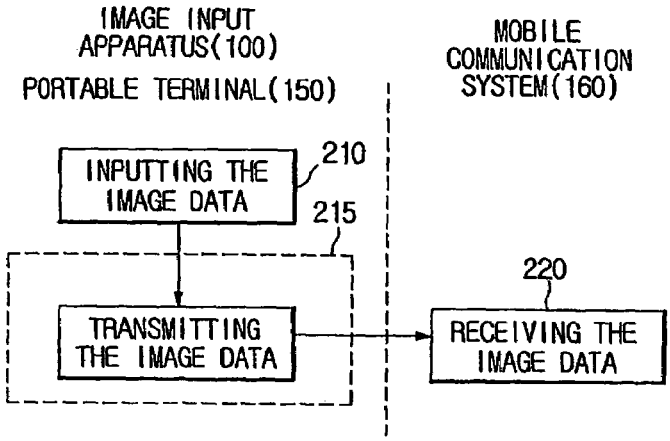

Referring to FIG. 3B, the transmitter 125 of the image input apparatus 100 transmits the image data to the portable terminal 150 through the local area network, and the portable terminal 150 transmits the received image data to the mobile communication system 160 through a network (step 215).

The step 215 further comprises the step of converting the inputted image data.

The transmitter 125 can transmit the image data to the portable terminal 150 through a wireless network or a wired network.

Referring to FIG. 3A again, the mobile communications system 160 receives the image data (step 220) and gets the driver's location data by the portable terminal 150 (step 225). The location data can be coordinate data comprising the latitude and the longitude.

The mobile communications system 160 transmits the image data and the location data to the security system 170 (step 230).

The process, which is accomplished by the mobile communication system 160, will be described.

The mobile communication system 160 comprises a base transceiver station(BTS), a base station controller(BSC), a visitor location register(VLR), a home location register (HLR), a mobile switching center(MSC), a data transmission server(a message server), and an inter-working function (IWF), etc.

The base transceiver station(BTS) received the image data from the portable terminal 150 and transmits it to the mobile switching center(MSC) under the control of the base station controller(BSC).

The mobile switching center(MSC) judges the location information of the portable terminal 150 through the visitor location register(VLR) and the home location register (HLR).

The data transmission server receives the image data and the location information and transmits them to the security system 170 by using the inter-working function(IWF).

The security system 170 receives the image data and the location data from the mobile communications system 160 (step 235). Thereafter, the security system 170 stores the image data and the location data in the storage 180 and displays them in the screen coupled with the security system 170 (step 240).

Also, the security system 170 can transmit the image data and the location data to a police station or a security company, which is located in its neighborhood.

Referring to FIG. 4A to FIG. 4D, the screen, which is coupled with the security system 170, displays the image data, which is received from the portable terminal 150, and the location data, which is received from the mobile communication system 160.

Figure 4A:
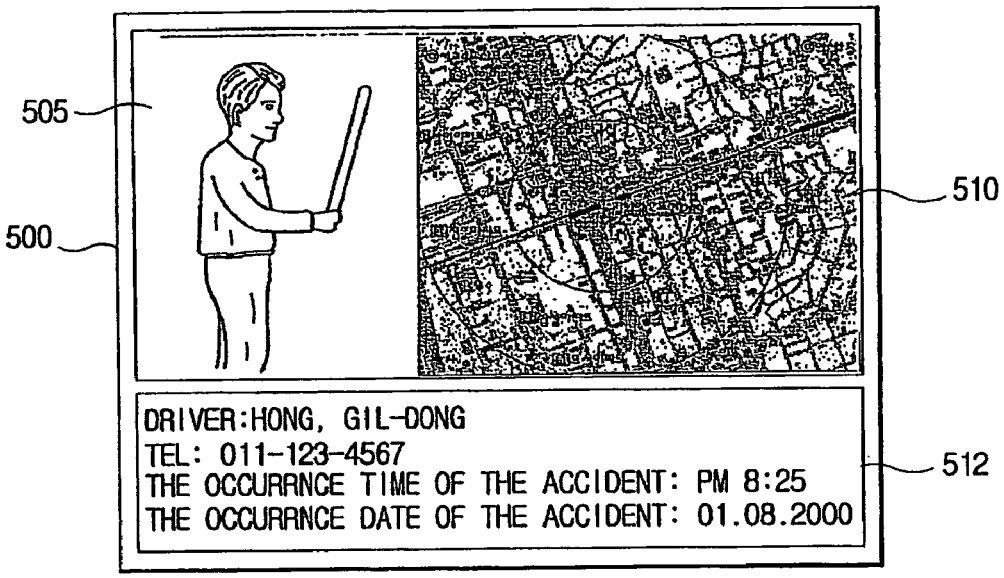
FIG. 4A to FIG. 4D are examples of screens displaying situational information according to one embodiment of the invention.

The screen of FIG. 4A can be composed of an image data display area 505, a location data display area 510, a driver information display area 512, etc.

The image data, which is displayed on the image data display area 505, is inputted by the image input unit 110 and transmitted by the portable terminal 150.

The location data display area 510 displays the driver's location data, which is obtained by the mobile communication system 160. The map regarding the driver and the driver's location are displayed as an image in the location data display area 510. The driver's location data can be displayed as image type or text type.

Also, the location data can be provided as text.

The driver information display area 512 is the area for displaying the driver's personal information and the event occurrence data/time, which is obtained by the mobile communication system 160 or the security system 170.

Figure 4B:
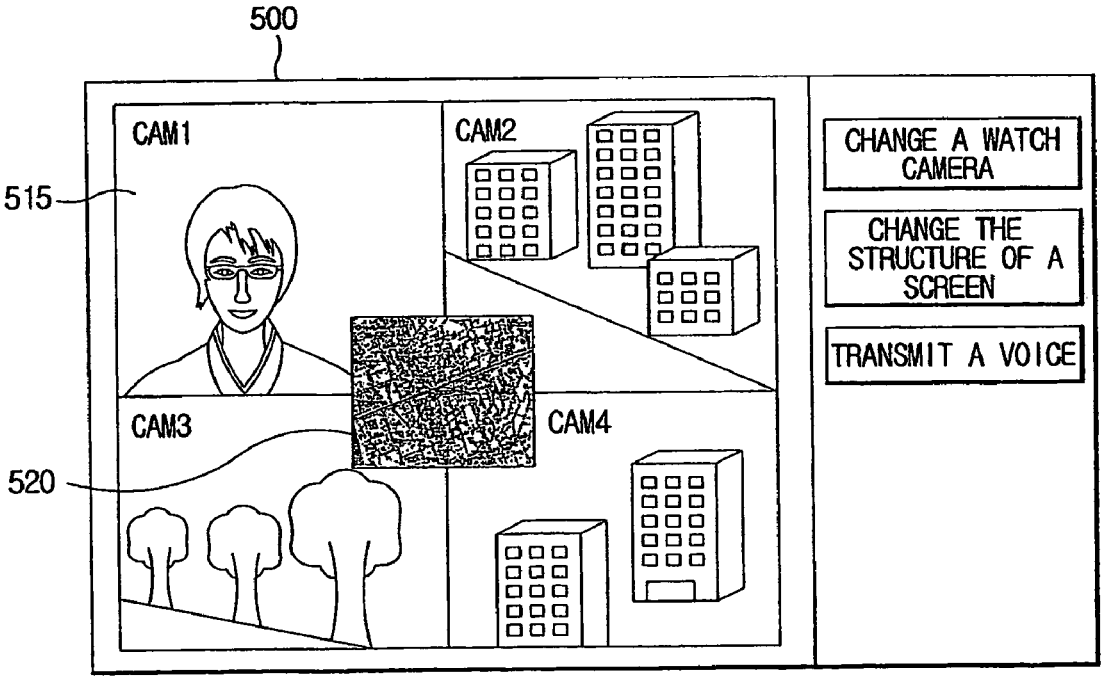

Referring to FIG. 4B, the screen 500 can be composed of a plurality of image data display area 515, and a location data display area 520. The screen 500 can further comprise a watch camera change button, a screen structure change button, and a voice transmission button. Also, the screen 500 of FIG. 4B can comprise the driver information display area 512.

If the vehicle has a plurality of image input units 110, then the screen 500 can be composed of a plurality of image data display areas 515. The image data display area 515 displays a still image or a real-time moving picture.

Also, even though the vehicle has one image input unit 110, the image data display area 515 can display the image data of the watch camera, which is set up by the other security system beforehand.

If the security staff pushes the watch camera change button of FIG. 4B by using input unit(for example, keyboard, mouse, etc.), then the security system displays a plurality of watch cameras. Then, he can select the other watch camera of them.

Figure 4C:
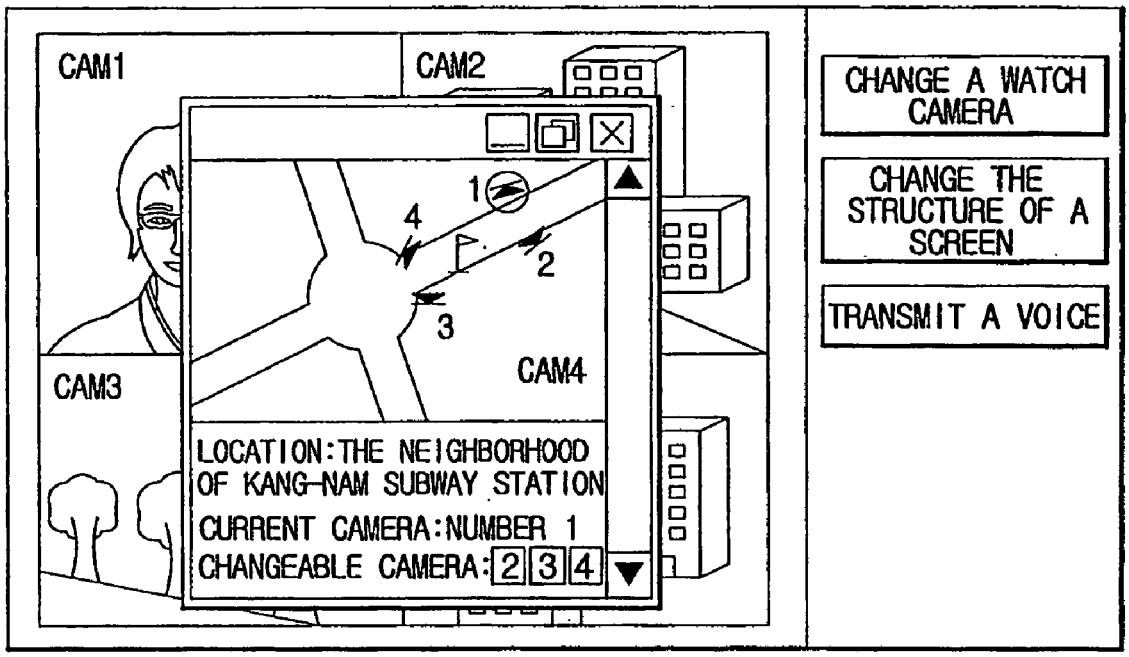
Figure 4D:
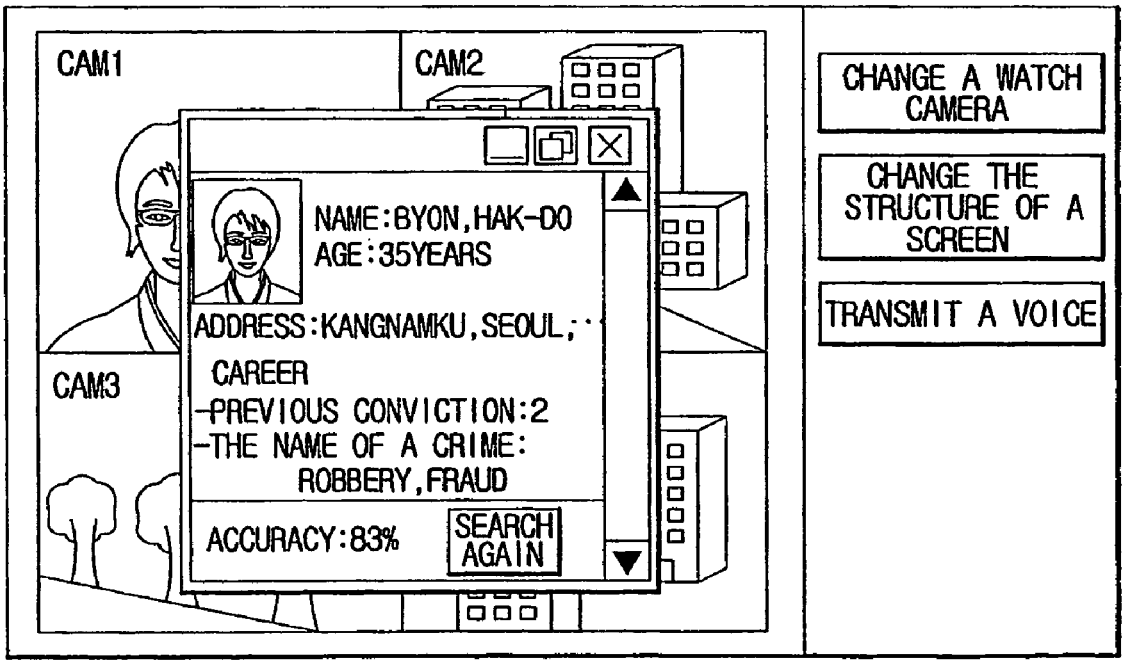

Referring to FIG. 4C, the display unit, which is coupled with the security system 170 or comprised within the security system 170, displays the driver's location, the watch camera location near the driver, the current camera number, and the watch camera information, which can be selected by the security staff.

The security staff can select the watch camera, which can provide the best image data, or a plurality of watch cameras.

Also, the security staff can enlarge or reduce the image data by using the image input unit 110.

If the security staff selects the intruder by using an input unit, the display unit displays the intruder information related to the intruder. The input unit can be a mouse or a keyboard and the intruder information can comprise the intruder's features, name, address and previous convictions.

The display unit can comprise precise information and a review button in order to provide correct features.

If the security staff pushes the screen structure change button of FIG. 4B, the number of the image data display area is increased of decreased.

The security staff can transmit real-time voice alert data to the intruder by using the voice transmission button.

Figure 3C:
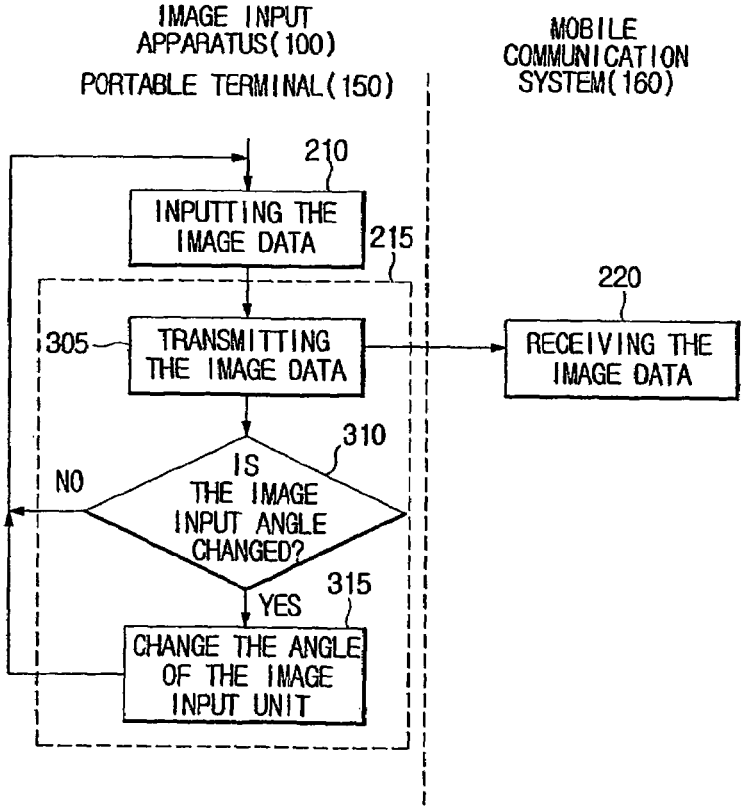

Referring to FIG. 3C, the transmitter 125 of the image input apparatus 100 transmits the image data inputted by step 210 to the mobile communication system 160 through a network (step 305).

The camera controller 135 of the image input apparatus 100 determines whether or not the image-angle-change command to change an image input angle is inputted by the driver (step 310). The image-angle-change command may be for changing the direction of the image input unit 110 or the angle of the lens.

For example, the driver can input the image-angle-change command to change an image input angle as follows.

The driver can change the lens direction of the watch camera (the angle of the image input unit) by using the number buttons of the portable terminal 150.

Also, the driver can enlarge or reduce the image data by using the direction buttons of the portable terminal 150.

If the image input unit 110 is coupled with a sensor, which can perceive the intruder's movement, then the image input unit 110 can change the angle of the camera lens corresponding to the intruder's movement.

Referring to FIG. 3C again, if the command is not inputted, then the process moves to the step 210.

If the command is inputted, then the image input apparatus 100 changes the angle of the image input unit 110 in response to the command (step 315) and commences the process from the step 210 again.

Figure 3D:
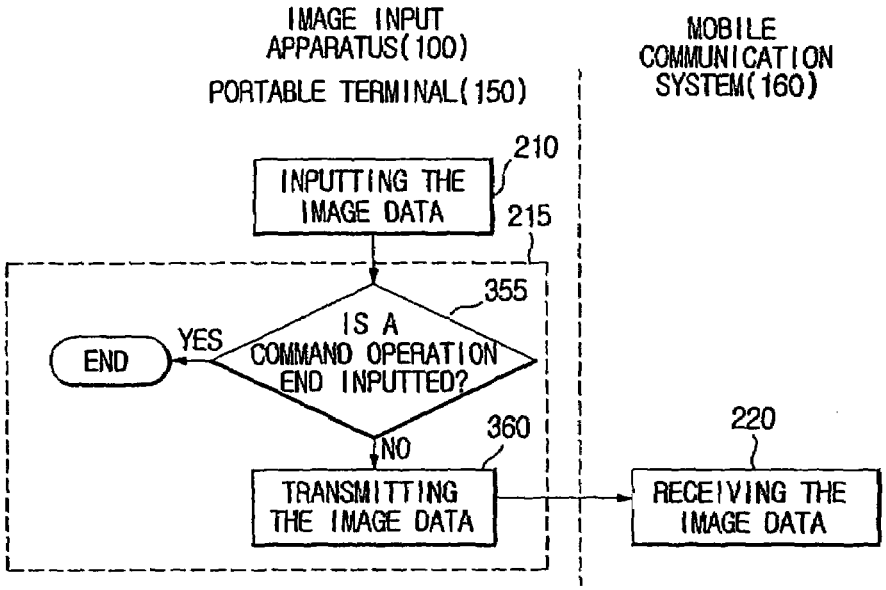

Referring to FIG. 3D, the power source controller 105 of the image input apparatus 100 determines whether or not the command operation end is inputted by the driver (step 355).

If the command operation end is inputted, then the power source controller 105 turns off the power, or the controller 115 stops the operation of the image input unit 110.

If the command operation end is not inputted, then the image data is transmitted to the mobile communication system 160 through a network (step 360).

Figure 3E:
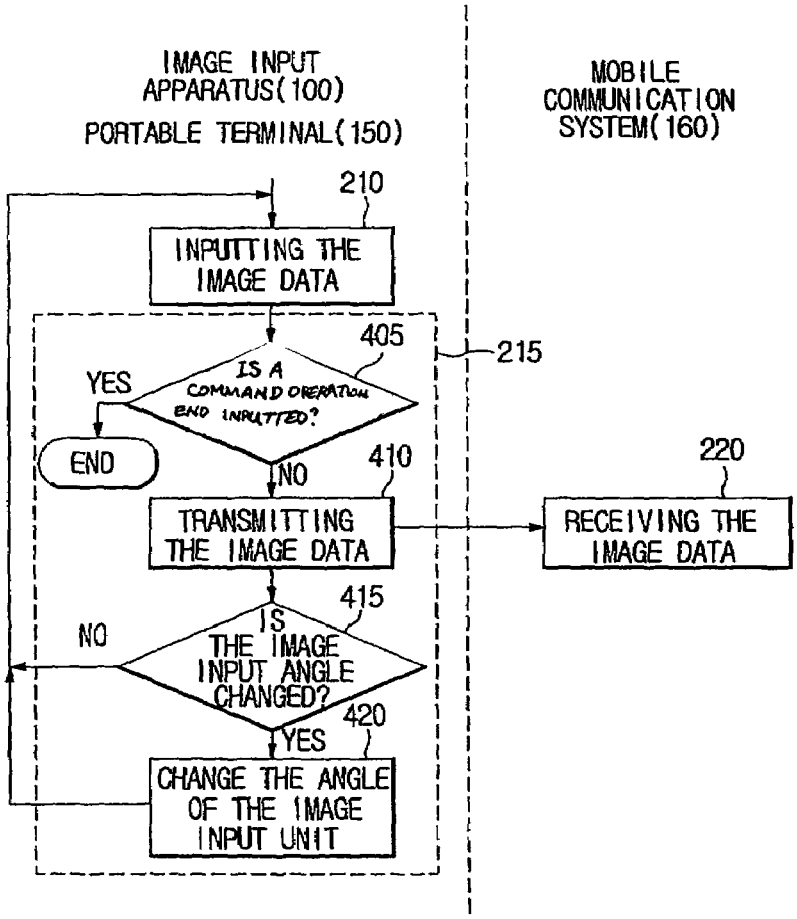

Referring to FIG. 3E, the power source controller 105 of the image input apparatus 100 determines whether or not the command operation end is inputted by the driver (step 405).

If the command operation end is inputted, then the process is over. If the command operation end is not inputted, then the image data is transmitted to the mobile communication system 160 through a network (step 410).

The camera controller 135 of the image input apparatus 100 determines whether or not the image-angle-change command to change an image input angle is inputted by the driver (step 415).

If the command is not inputted, then the image input apparatus 100 moves to the step 210.

If the command is inputted, then the image input apparatus 100 changes the angle of the image input unit 110 in response to the command (step 420) and commences the process from the step 210 again.

Figure 5:
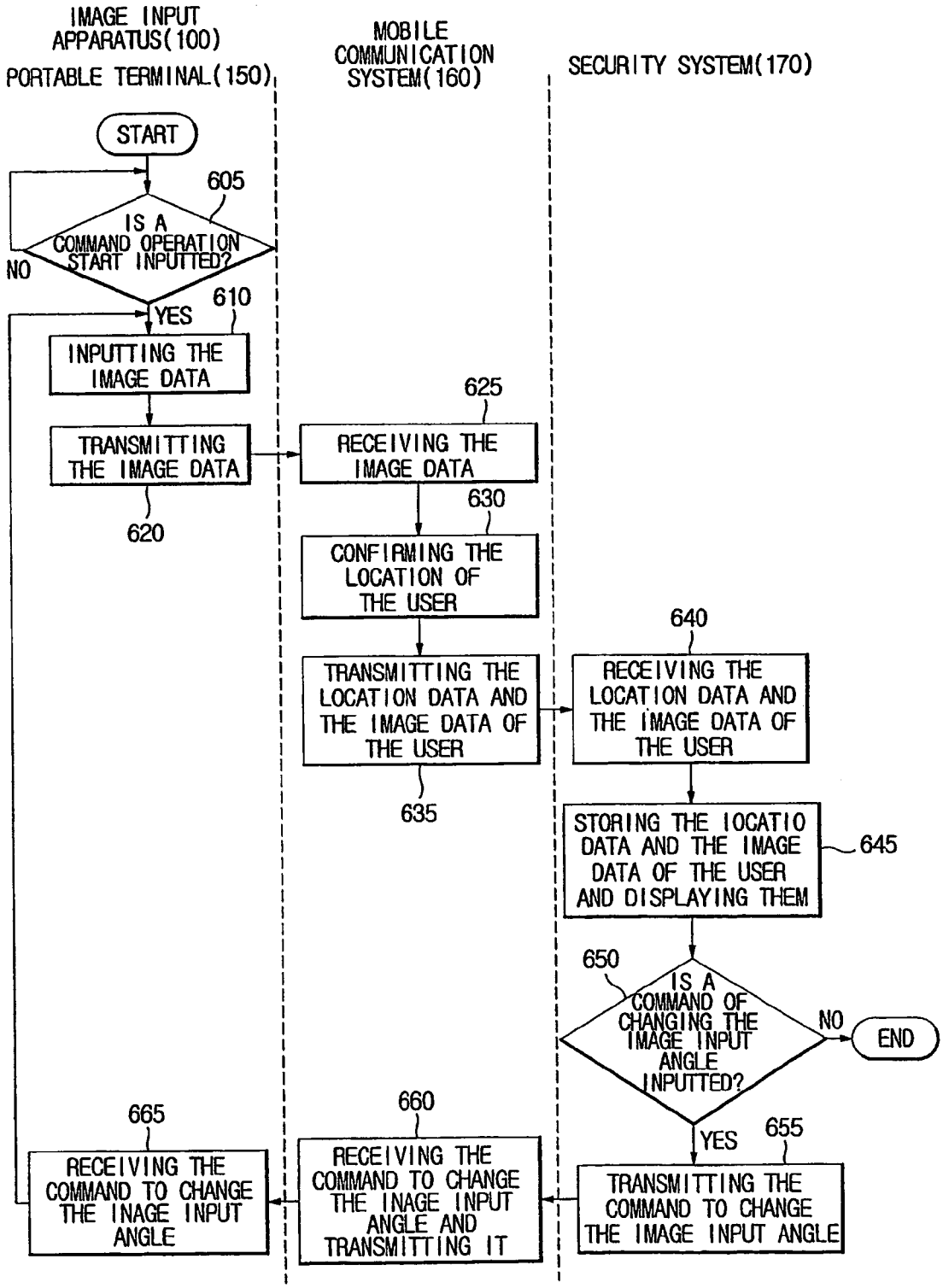
FIG. 5 is a flowchart illustrating the process of controlling the image input angle at a long distance according to one embodiment of the invention.
Figure 6:
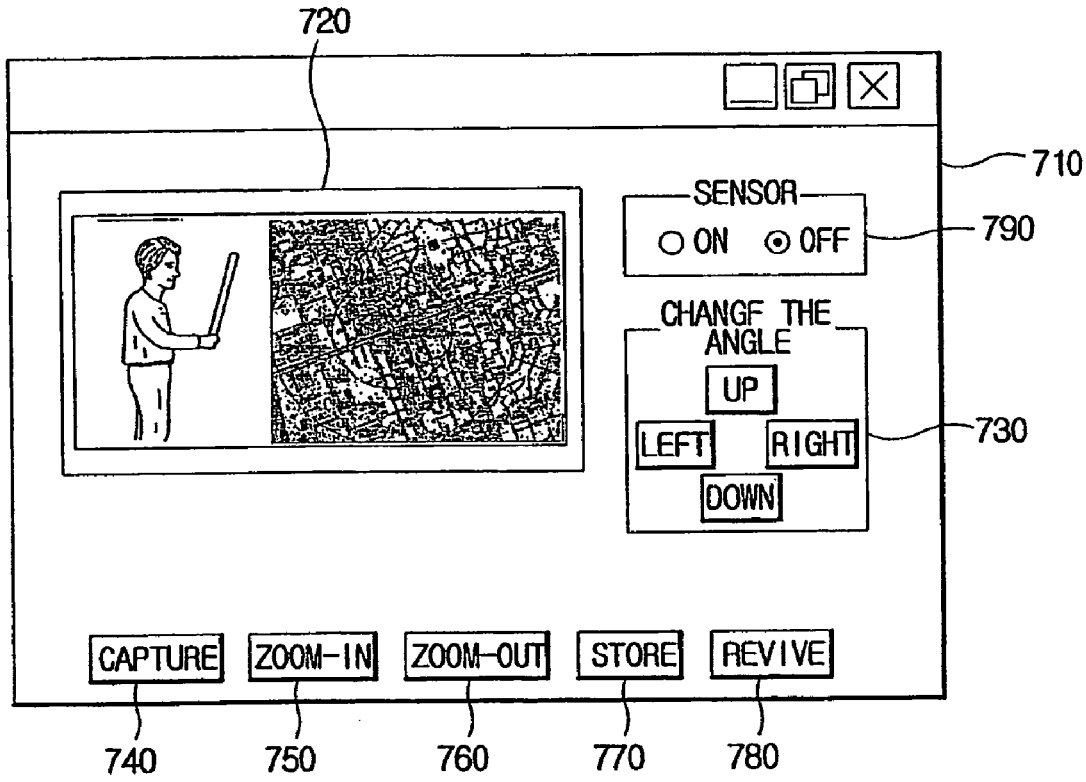
FIG. 6 is an example of a screen for controlling the image input angle at a long distance according to one embodiment of the invention.

FIG. 5 is a flowchart illustrating the process of controlling the image input angle at a long distance according to one embodiment of the invention and FIG. 6 is an example of a screen for controlling the image input angle at a long distance according to one embodiment of the invention.

We will omit the steps 605 through 645 of FIG. 5 because they are the same steps described in FIG. 3A and FIG. 3B.

Referring to FIG. 5, the security system 170 determines whether or not the image-angle-change command to change an image input angle is inputted by the security staff or a policeman (step 650).

Referring to FIG. 6, the angle control screen 710 can be composed of a data display area 720, an angle change area 730, a capture button 740, a zoom-in button 750, a zoom-out button 760, a storage button 770, a revive button 780, a sensor area 790, etc.

The security staff confirms the image data and the location data, which is displayed on the data display area 720, and changes the angle of the image input unit 110 by using the direction buttons of the angle change area 730.

Also, if the security staff pushes the capture button 740, then the image input unit 110 creates a still image by using the image data of the data display area 720.

The security staff can enlarge or reduce the image data of the data display area 720 by using the zoom-in button 750 or the zoom-out button 760.

The storage 180 of the security server 175 stores the received image data automatically. Also, if the security staff pushes the storage button 770, then the storage 180 stores the image data, which is displayed on the data display area 720.

If the security staff pushes the revive button 780, then the image input unit 110 revives the image data stored in the storage 180.

If the image input unit 110 is coupled with a sensor, which can perceive the intruder's movement, and the 'ON' item of the sensor area 790 is selected, then the image input unit 110 can change the angle of the camera lens corresponding to the intruder's movement.

Referring to FIG. 5, if the command is not inputted, then the process is over. On the other hand, if the command is inputted, then the security system 170 transmits the command to the mobile communication system 160 (step 655). The mobile communication system 160 receives the command and transmits it to the portable terminal 150 (step 660).

If the portable terminal 150 receives the command from the mobile communication system 160, then the command is transmitted to the image input apparatus 100 through a wireless network. The image input apparatus changes the angle of the image input unit 110 corresponding to the command (step 665). And then, the process moves to the step 610.

Because the image data is transmitted to the security system 170 through the portable terminal 150 and the mobile communication system 160, the security system confirms the driver without authentication process.

Also, the security system 170 can store the personal information, which comprises name, telephone, address, etc., as well as the image data and the location data.

Figure 7:
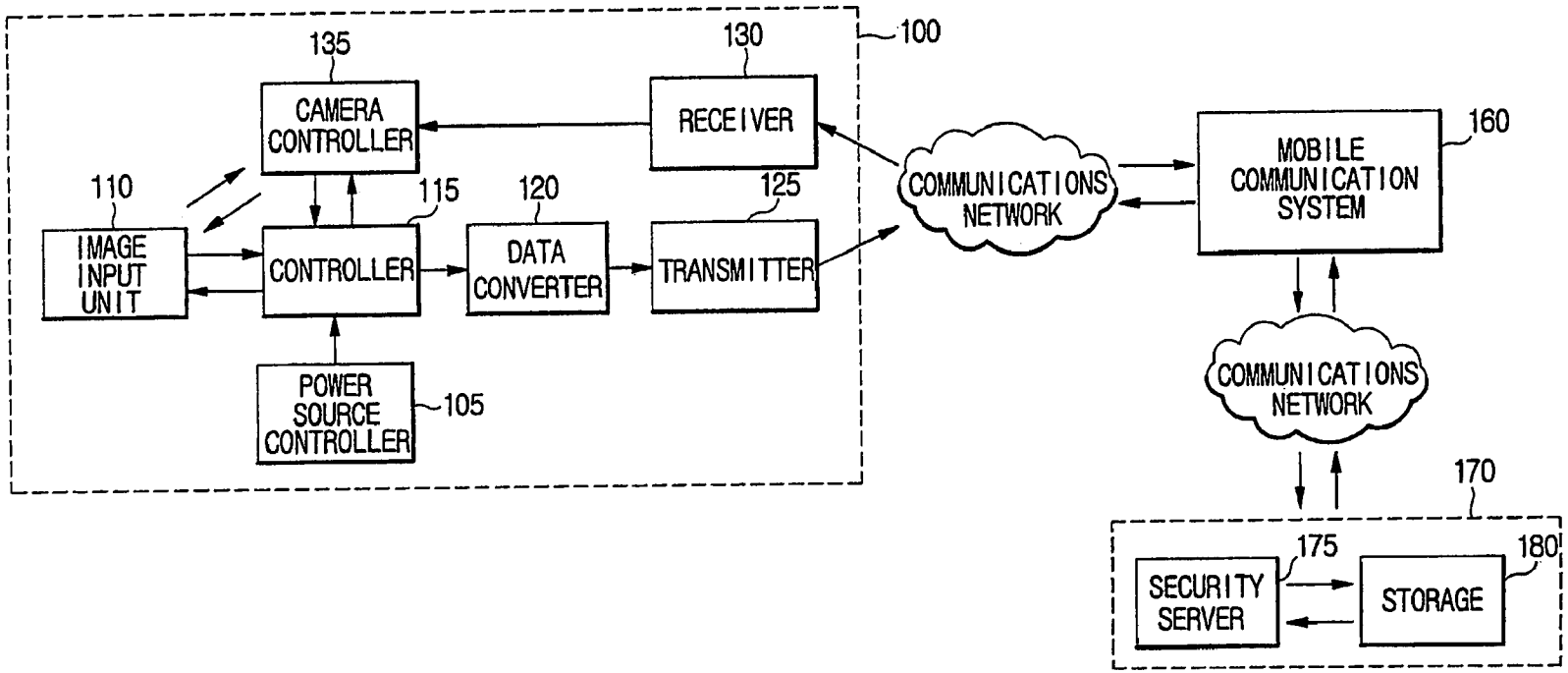
FIG. 7 is a schematic diagram of the system for informing a critical situation by using a network according to another embodiment of the invention.

FIG. 7 is a schematic diagram of the system for informing a critical situation by using a network according to another embodiment of the invention.

Referring to FIG. 7, another critical situation informing system can comprise an image input apparatus 100, a mobile communication system 160, a security system, etc.

The image input apparatus 100 can comprise a power source controller 105, an image input unit 110, a controller 115, a data converter 120, a transmitter 125, a receiver 130, a camera controller 135, etc.

The transmitter 125 transmits data to the mobile communication system 160, and the receiver 130 receives data from the mobile communication system 160 not passing the portable terminal.

Another system can accomplish the role of the mobile communication system 160.

If the image input apparatus 100 is started in response to the driver's command operation start, then the image input apparatus 100 inputs the image data of the surrounding situation.

The transmitter 125 transmits the image data to the mobile communication system 160. The mobile communication system 160 receives the image data from the transmitter 125 and confirms the driver's location data by using the portable terminal. And then, the mobile communication system 160 transmits the image data and the location data to the security system 170.

The security system 170 receives the image data and the location data from the mobile communications system 160 and stores them in the storage 180 and displays them on the screen coupled with the security system 170.

The critical situation informing system of FIG. 7 does not comprise the portable terminal. The driver's personal information and the serial number image of the input apparatus 100 must be registered on the mobile communications system 160 in order to perceive the driver's identity.

The method to change the angle of the image input unit 110 is the same as described in FIG. 3C, FIG. 3E, and FIG. 5.

Figure 8:
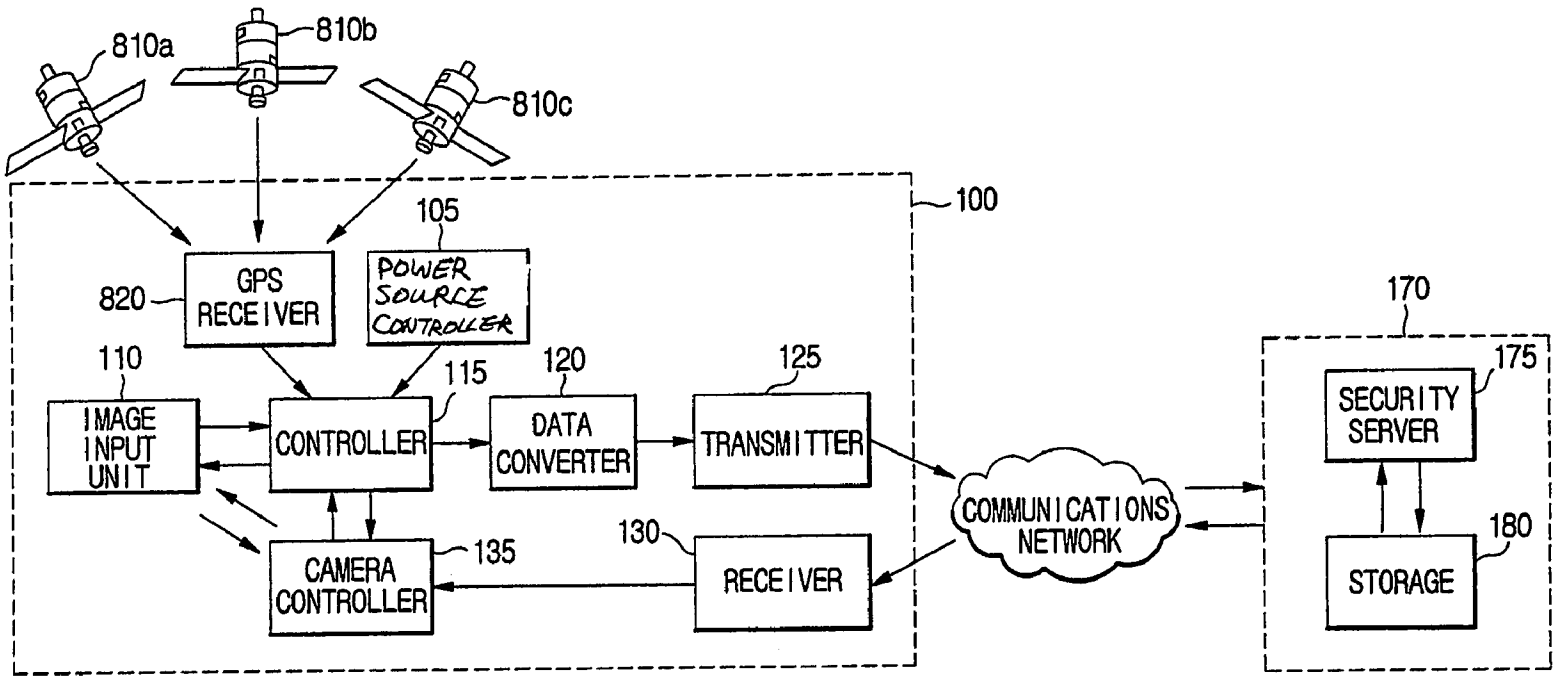
FIG. 8 is a schematic diagram of the system for informing a critical situation by using a network according to another embodiment of the invention.

FIG. 8 is a schematic diagram of the system for informing a critical situation by using a network according to another embodiment of the invention.

Referring to FIG. 8, the critical situation informing system uses the image input apparatus 100, the security system 170, and GPS satellite 810 (810 indicates 810*a*, 810*b*, 810*c*).

The image input apparatus 100 can comprise a power source controller 105, an image input unit 110, a controller 115, a data converter 120, a transmitter 125, a receiver 130, a camera controller 135, a GPS receiver 820, etc.

The GPS system perceives the driver's location data, and the driver can connect to the network like the Internet by using the image input apparatus 100.

The GPS receiver 820 receives the electronic wave from the GPS satellite 810 and calculates the driver's location data by using the electronic wave and then transmits the location data to the controller 115.

If the driver's car has a navigation system, the driver can use the location data, which is provided by the GPS system.

The controller 115 transmits the image data, which is inputted by the image input unit 110, and the location data, which is received by the GPS receiver 820, to the data converter 120. The data converter 120 converts the image data and the location data into situational data, and the transmitter 125 transmits the situational data to the security system 170.

Because the critical situation informing system of FIG. 8 does not comprise the portable terminal, the driver's personal information and the proper network address of the image input apparatus 100 must be registered on the mobile communications system 160 in order to perceive the driver's identity.

The proper network address can comprise IP address of the image input apparatus 100 or the proper number(for example, product code, serial number) of the image input apparatus 100.

Also, the storage 180 of the security system 170 can comprise an IP address database, and an image input apparatus database.

Figure 9:
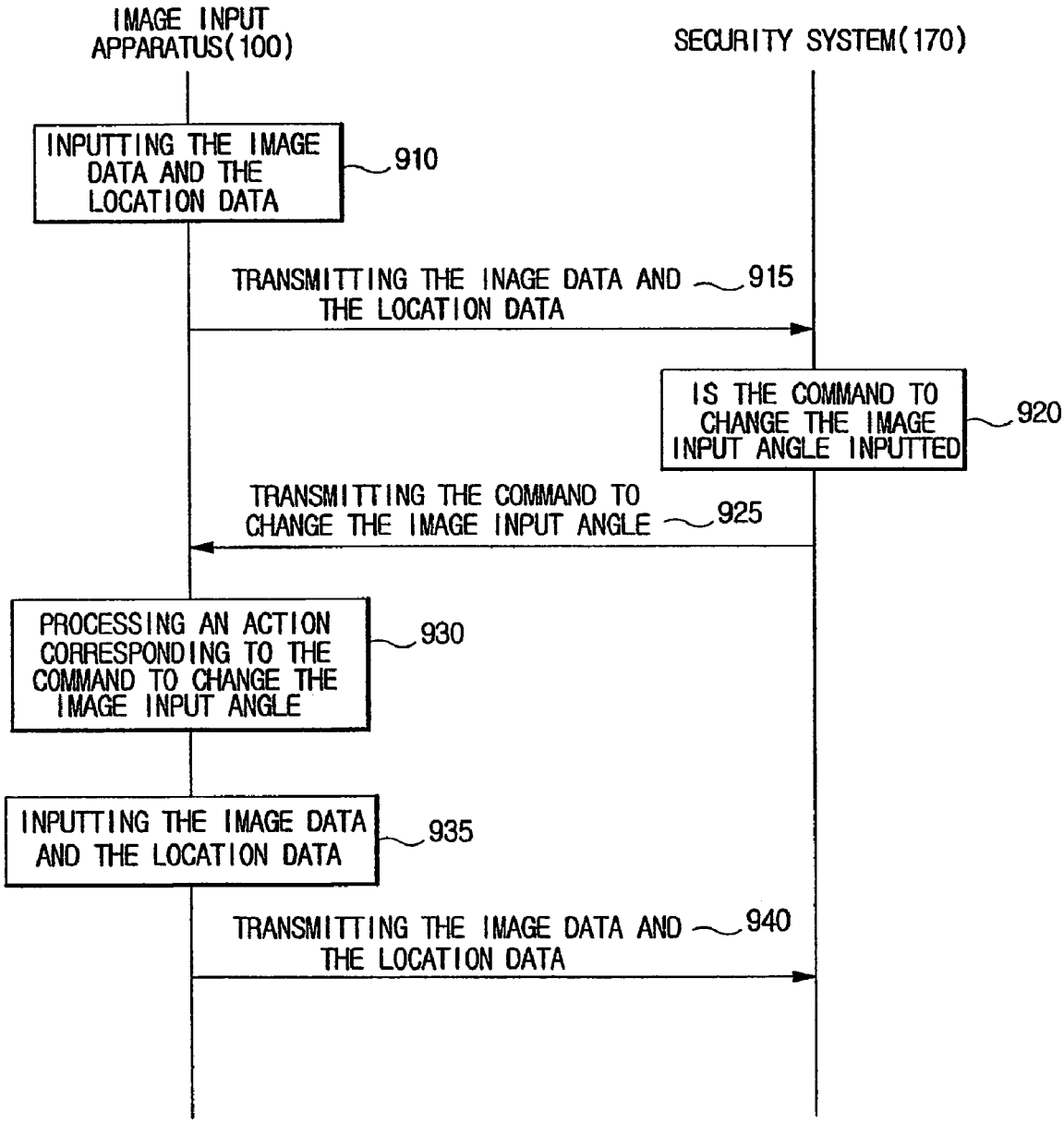
FIG. 9 is a flowchart illustrating the process of controlling the image input angle at a long distance according to another embodiment of the invention.

FIG. 9 is a flowchart illustrating the process of controlling the image input angle at a long distance according to another embodiment of the invention.

Referring to FIG. 9, the image input apparatus 100 inputs the image data and the location data (step 910) and then transmits them to the security system 170 (step 915).

If the security system 170 receives the image data and the location data, then the security system 170 displays them on the screen. If the security staff inputs the image-angle-change command to change the angle of the image input unit 115 (step 920), then the security system transmits the image-angle-change command to the image input apparatus 100 (step 925).

The image input apparatus 100 accomplishes an operation corresponding to the command (step 930) and inputs the image data and the location data (step 935) and transmits them to the security system 170 (step 940).

Also, the system of the present invention can transmit and receive voice data if the system comprises a voice input-output apparatus.

If the security system has the voice input-output apparatus, the security staff can perceives the intruder with accuracy by using the intruder's voice data. Also, the security staff can transmit real-time voice alert message to the intruder by using the voice input-output apparatus.

Also, the present invention applies to a man returning home in the late night.

He has a portable terminal 150 in his bag or in his pocket and exposes the image input unit 110 or the voice input-output apparatus, which is coupled with the portable terminal 150 to outside. Then the image data and the voice data, which is inputted by the image input unit 110 or the voice input-output apparatus, is transmitted to the security system 170.

The security staff or policeman uses the image data and the voice data to search the intruder or to deal with a traffic accident.

Figure 10A:
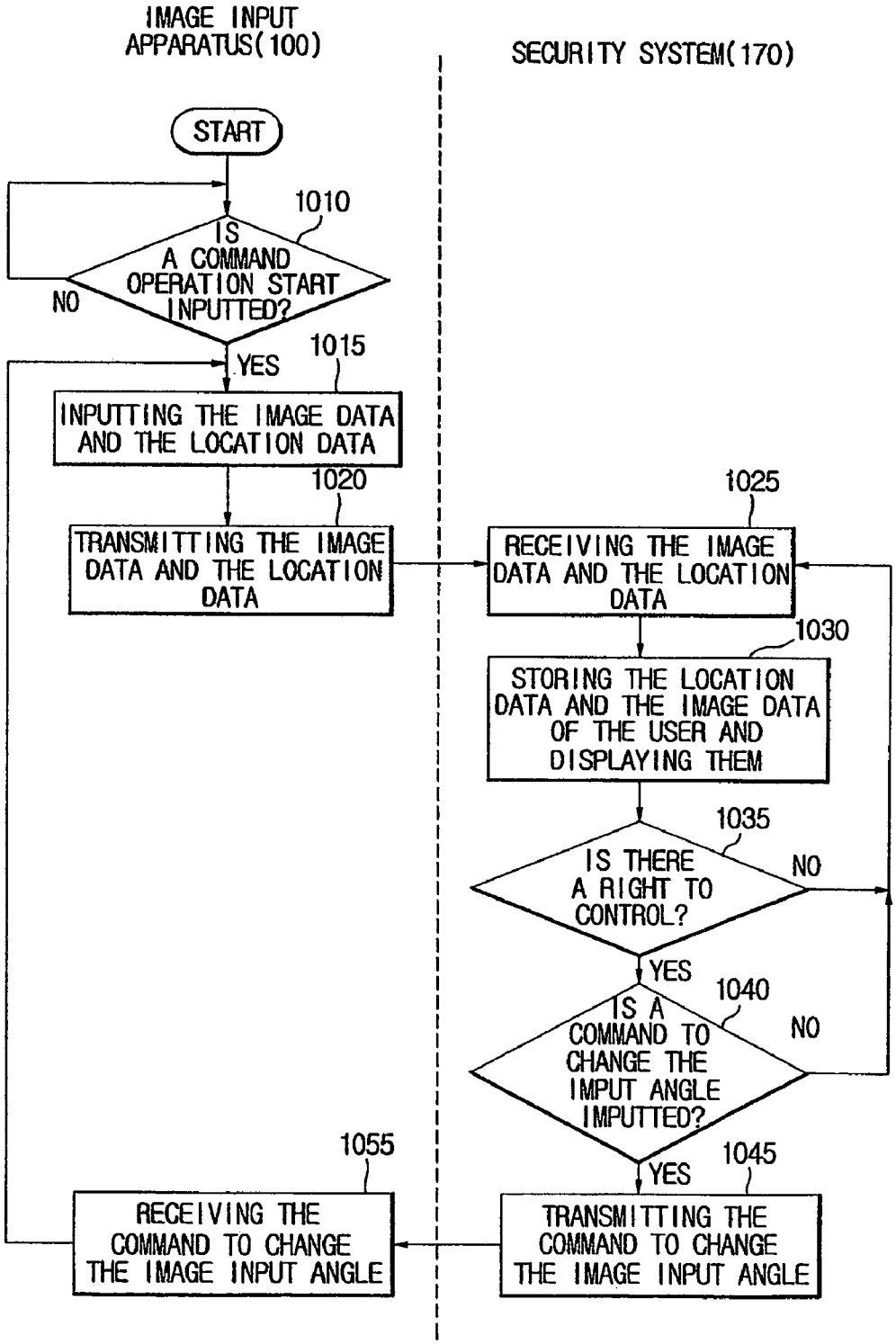
FIG. 10A is a flowchart illustrating the process of giving a right of controlling an image input unit according to another embodiment of the invention.

FIG. 10A is a flowchart illustrating the process of giving a right of controlling an image input unit according to another embodiment of the invention.

Referring to FIG. 10A, the image input apparatus 100 determines whether or not the command operation start is inputted by the driver (step 1010).

If the command is not inputted, then the image input apparatus 100 waits until the user inputs the command operation start.

If the command is inputted, then the image input apparatus 100 inputs the image data and the location data (step 1015) and transmits them to the security system 170 (step 1020).

The security system 170 receives the image data and the location data (step 1025) and stores and displays them (step 1030). The security staff perceives the critical situation by the image data, the location data, and the voice data.

The security system 170 determines whether or not the system 170 can control the driver's image input unit 110 at a long distance (step 1035).

The driver can control the image input apparatus 100 at a long distance by using critical situation data. We will describe the data model of the critical situation data referring to FIG. 10B.

Referring to FIG. 10B, the critical situation data can comprise a header information area(HEADER), a terminal information area(TER_INF), a control information area (CON_INF), an image data area(IMA_DAT), a voice data area(SND_DAT), a location data area(LOC_DAT), a tail area(TAIL), etc.

The terminal information area(TER_INF) comprises the driver's telephone number, etc. If the image input unit 110 can connect to the security system 170 without the portable terminal directly, then the terminal information area(TER_INF) comprises the serial number of the image input unit 110. The mobile communication system 160 and the security system 170 can identify the driver's identity by using the data of the terminal information area(TER_INF).

The image input apparatus 100 can be controlled by the driver. On the other hand, if the driver cannot control the image input apparatus 100, then the other people can control the image input apparatus 100 remotely.

The control information area(CON_INF) comprises the remote control right data to control the image input unit 110. The information of the control information area(CON_INF) is "OFF".

If the driver inputs the input signal of the power source controller one more time or pushes the remote control permission button, then the remote control can be permitted.

Also, the control information area(CON_INF) can comprise the input direction, the angle, and the enlargement rate of the image input unit 110.

The image data area(IMA_DAT) comprises the image data of the critical situation, and the voice data area(SND_DAT) comprises the voice data of the critical situation. The location data area(LOC_DAT) comprises the location data of the driver.

If the data, which is inputted by the image input apparatus 100, is transmitted to the security system through the mobile communication system, then the mobile communication system identifies the driver's location. Therefore, the location data area(LOC_DAT) can be omitted.

Referring to FIG. 10A again, if the system can control the image input unit 110, then the security system 170 determines whether or not the image-angle-change command to change the angle of the image input unit 110 is inputted by the security staff (step 1040).

If the command is not inputted, then the security system 170 accomplishes the steps from the step 1025 again.

If the command is inputted, then the security system 170 transmits the image-angle-change command to the image input apparatus 100 (step 1045). The image input apparatus 100 receives the command (step 1055) and changes the angle of the image input unit 110 and accomplishes the steps from the step 1015 again.

There are various methods for releasing the remote control right of the security system 170. If the driver inputs the release command to release the remote control right, then the remote control right of the security system 170 is released. For example, the driver inputs the input signal of the power source controller one more time or pushes the remote control permission button.

This method is convenient but potentially dangerous for the driver because the remote control right can be easily released by the intruder.

We can apply another method to overcome this defect.

Firstly, the driver should input the release command and a password. If the password is correct, then the remote control right is released. If the password is incorrect, then the remote control right is maintained.

Secondly, if the driver inputs the release command, then the security staff of the security system 170 perceives the situation by the image data and releases the remote control right.

Thirdly, the car of the driver has two release command buttons, whereby one is the real release command button while the other is a decoy. For example, if the driver pushes the fake release command button due to the intruder's threat, then it would appear that the remote control right and the security function has ceased but instead the image data of the situation is continuously being transmitted to the security system 170.

Also, the driver can input a image-data-delete command to delete the image data stored on the security system 170 by using the image input apparatus 100.

While the above description has pointed out novel features of the invention as applied to various embodiments, the skilled person will understand that various omissions, substitutions, and changes in the form and details of the device or process illustrated may be made without departing from the scope of the invention. Therefore, the scope of the invention is defined by the appended claims rather than by the foregoing description. All variations coming within the meaning and range of equivalency of the claims are embraced within their scope.

What is claimed is:

1. A method of informing an emergency situation using a communication network, comprising:

generating image data indicative of an emergency situation, associated with a user, in response to the user's image input request;

converting the image data into a form which is communicable over a mobile wireless communication network; and transmitting the image data to a portable terminal via a wired network or a wireless local area network, wherein the portable terminal transmits the image data via the mobile wireless communication network to a security system, and the portable terminal comprises at least one of a mobile wireless communication terminal, a personal computer and a PDA (personal digital assistant).

2. The method of claim 1, further comprising:

determining whether or not an image-angle-change command to change the angle of an image generating unit has been received from the user or the security system;

if the image-angle-change command has been received, changing the angle of the image generating unit; and generating image data at the changed angle of the image generating unit, wherein the image-angle-change command is received by a user via the portable terminal.

3. The method of claim 1, further comprising:

if a voice data input request is received from the user or the security system, inputting sound data indicative of the emergency situation;

converting the sound data into a form which is communicable over the communication network; and transmitting the sound data to the security system.

4. The method of claim 1, further comprising:

receiving geographic information from a GPS satellite;

determining a current location of the user from the geographic information;

converting the current location into location data which is communicable over the mobile communication network; and transmitting the location data to the security system.

5. The method of claim 1, further comprising:

determining whether or not an alert signal has been received from the security system via the mobile wireless communication system; and outputting the alert signal on a user's sound device when the alert signal has been received.

6. The method of claim 1, further comprising transmitting data comprising a right-given command from the user to the security system to allow remote control of the angle of an image generating unit.

7. The method of claim 1, wherein the image data is generated by an image capturing device, in data communication with the portable terminal.

8. The method of claim 7, wherein the user's image input request is made via a key button of the portable terminal.

9. A method of informing an emergency situation using a communication network, comprising:

receiving image data indicative of an emergency situation, associated with a user, via a mobile communication network, wherein the image data are transmitted from at least one of a portable terminal and an image input apparatus coupled to a vehicle;

searching information corresponding to the user, wherein the user information comprises at least one of the user's telephone number and IP address;

obtaining the user's location;

converting the location into location data which is communicable over the mobile communication network; and transmitting the image data and the location data to a security system.

10. The method of claim 9, further comprising;

receiving sound data indicative of an emergency situation from at least one of the portable terminal and the image input apparatus; and transmitting the sound data to the security system.

11. A method of informing an emergency situation using a communication network, comprising:

receiving image data from at least one of a portable terminal and an image input apparatus via a communication network, wherein the image data is indicative of an emergency situation;

storing the image data in a storage medium;

displaying the image data on a screen; and utilizing the data to inform a security staff of the emergency situation, wherein the image data is stored automatically or in response to an image storage command initiated by a security staff.

12. The method of claim 11, further comprising:

receiving an angle-change command to change the angle of the image input apparatus from the security staff; and transmitting the angle-change command to at least one of the portable terminal and the image input apparatus.

13. The method of claim 12, wherein the transmitting the angle-change command comprises determining whether or not the security system has received a right-given command from at least one of the portable terminal and the image input apparatus to allow remote control of the angle of the image input apparatus.

14. The method of claims 11, further comprising:

receiving location data from at least one of the portable terminal and the image input apparatus; and displaying a user's location on the screen by using the location data, wherein the location data is displayed as a map or text.

15. The method of claim 11, further comprising:

receiving sound data indicative of an emergency situation from at least one of the portable terminal and the image input apparatus; and storing the sound data in the storage medium.

16. The method of claim 11, further comprising:

receiving an alert signal from the security staff responsive to the emergency situation;

converting the alert signal into alert signal data which is communicable over the mobile communication network; and transmitting the alert signal data to at least one of the portable terminal and the image input apparatus over the communication network.

17. A system for informing an emergency situation using a communication network, the system comprising:

an image generator configured to generate image data indicative of an emergency situation, associated with a user, in response to the user's image input request;

a converter configured to convert the image data into a form which is communicable over a mobile communication network; and a transmitter configured to transmit the image data to a portable terminal via a wired network or a wireless local area network, wherein the portable terminal transmits the image data over the mobile communication network to a security system.

18. The system of claim 17, wherein the image generator is located on a vehicle.

19. The system of claim 17, further comprising:

means for determining whether or not an image-angle-change command to change the angle of the image generator has been received from the user or the security system; and means for changing the angle of the image generator, wherein if the image-angle-change command has been received, the changing means are configured to change the angle of the image generator.

20. The system of claim 17, further comprising:

means for receiving sound data indicative of the emergency situation in response to a voice data input request received from at least one of the user and the security system;

means for converting the sound data into a form which is communicable over the communication network; and means for transmitting the sound data to the security system.

21. The system of claim 17, further comprising:

means for receiving geographic information from a GPS satellite;

means for determining a current location of the user from the geographic information;

means for converting the current location into a form that is communicable over the communication network; and means for transmitting the location data to the security system.

22. The system of claim 17, further comprising the means for transmitting data comprising a right-given command from the user to the security system to allow remote control of the angle of the image generator.

23. The system of claim 17, wherein the portable terminal comprises at least one of a mobile wireless communication terminal, a personal computer and a PDA (personal digital assistant).

24. A system for informing an emergency situation using a communication network, the system comprising:

means for receiving an image data indicative of an emergency situation from at least one of a portable terminal and an image input apparatus via a communication network;

means for storing the image data;

means for displaying the image data; and means for utilizing the data to inform a security staff of the emergency situation, wherein the image data is stored automatically or in response to an image storage command initiated by a security staff.

25. The system of claim 24, further comprising:

means for receiving an angle-change command to change the angle of the image input apparatus from the security staff; and means for transmitting the angle-change command to at least one of the portable terminal and the image input apparatus.

26. The system of claim 24, further comprising:

means for receiving location data from at least one of the portable terminal and the image input apparatus; and means for displaying the user's location on a screen based on the location data, wherein the location data is displayed as a map or text.

27. The system of claim 24, further comprising:

means for receiving sound data indicative of the emergency situation from at least one of the portable terminal and the image input apparatus, wherein the sound data are stored in the storing means;

means for receiving an alert signal from the security staff;

means for converting the alert signal into alert signal data which is communicable over the communication network; and means for transmitting the alert signal data to at least one of the portable terminal and the image input apparatus over the communication network.

* * * * *

UNITED STATES PATENT AND TRADEMARK OFFICE

CERTIFICATE OF CORRECTION

PATENT NO. : 7,091,829 B2
APPLICATION NO. : 10/826815
DATED : August 15, 2006
INVENTOR(S) : Hong-Kyu Lee It is certified that error appears in the above-identified patent and that said Letters Patent is hereby corrected as shown below:

In the Drawings

| Column | Line | Error Description |
|---|---|---|
| Sheet 7 of 15 (Box 512) (FIG. 4A) | 3 | Delete "OCCURRNCE" and insert -- OCCURRENCE --, therefor. |
| Sheet 7 of 15 (Box 512) (FIG. 4A) | 4 | Delete "OCCURRNCE" and insert -- OCCURRENCE --, therefor. |
| Sheet 9 of 15 (Box 645) (FIG. 5) | 1 | Delete "IOCATIO" and insert -- LOCATION --, therefor. |
| Sheet 9 of 15 (Box 665) (FIG. 5) | 3 | Delete "INAGE" and insert -- IMAGE --, therefor. |
| Sheet 9 of 15 (Box 660) (FIG. 5) | 3 | Delete "INAGE" and insert -- IMAGE --, therefor. |
| Sheet 10 of 15 (Box 730) (FIG. 6) | 1 | Delete "CHANGF" and insert -- CHANGE --, therefor. |
| Sheet 13 of 15 (Reference Numeral 915) (FIG. 9) | 1 | Delete "INAGE" and insert -- IMAGE --, therefor. |
| Sheet 14 of 15 (Box 1040) (FIG. 10A) | 4 | Delete "IMPUT" and insert -- INPUT --, therefor |
| Sheet 14 of 15 (Box 1040) (FIG. 10A) | 5 | Delete "IMPUTTED" and insert -- INPUTTED --, therefor. |
| 3 | 28 | After "network" insert -- . --. |
| 8 | 48 (Approx.) | Delete "angle change" and insert -- angle-change --, therefor. |
| 8 | 55 (Approx.) | Delete "angle change" and insert -- angle-change --, therefor. |

UNITED STATES PATENT AND TRADEMARK OFFICE

CERTIFICATE OF CORRECTION

PATENT NO. : 7,091,829 B2
APPLICATION NO. : 10/826815
DATED : August 15, 2006
INVENTOR(S) : Hong-Kyu Lee It is certified that error appears in the above-identified patent and that said Letters Patent is hereby corrected as shown below:

| | | |
|---|---|---|
| 12 | 49 | Delete "a" and insert -- an --, therefor. |

Signed and Sealed this

Thirtieth Day of January, 2007

JON W. DUDAS
*Director of the United States Patent and Trademark Office*